US009466268B2

(12) United States Patent
Knight

(10) Patent No.: US 9,466,268 B2
(45) Date of Patent: Oct. 11, 2016

(54) FOLDING STRINGED INSTRUMENT

(71) Applicant: Iain Thomas Knight, Hampshire (GB)

(72) Inventor: Iain Thomas Knight, Hampshire (GB)

( * ) Notice: Subject to any disclaimer, the term of this patent is extended or adjusted under 35 U.S.C. 154(b) by 0 days.

(21) Appl. No.: 14/915,485

(22) PCT Filed: Aug. 28, 2014

(86) PCT No.: PCT/GB2014/052606
§ 371 (c)(1),
(2) Date: Feb. 29, 2016

(87) PCT Pub. No.: WO2015/028800
PCT Pub. Date: Mar. 5, 2015

(65) Prior Publication Data

US 2016/0225351 A1 Aug. 4, 2016

(30) Foreign Application Priority Data

Aug. 30, 2013 (GB) ..... 1315523.9

(51) Int. Cl.
*G10D 1/08* (2006.01)
*G10D 3/06* (2006.01)
*G10D 3/12* (2006.01)
*G10D 3/14* (2006.01)

(52) U.S. Cl.
CPC *G10D 1/08* (2013.01); *G10D 3/06* (2013.01); *G10D 3/12* (2013.01); *G10D 3/14* (2013.01)

(58) Field of Classification Search
CPC ..... G10D 1/08
See application file for complete search history.

(56) References Cited

U.S. PATENT DOCUMENTS 4,073,211 A * 2/1978 Jorgensen ..... G10D 3/06 84/267
4,111,093 A * 9/1978 Field ..... G10D 3/06 84/267
4,780,929 A * 11/1988 Burns ..... A63C 5/02 16/343
5,233,896 A * 8/1993 Worthington ..... G10D 3/06 84/293
5,383,385 A * 1/1995 Gilbert ..... G10D 1/085 84/293
5,390,578 A * 2/1995 Raymer ..... G10D 1/085 84/267
6,025,548 A * 2/2000 Ehrlich ..... G10D 1/08 84/267
6,353,164 B1 * 3/2002 Corsi ..... G10D 3/06 84/290

(Continued)

FOREIGN PATENT DOCUMENTS

EP 1602101 11/2007
GB 2485170 9/2012

*Primary Examiner* — Robert W Horn
(74) *Attorney, Agent, or Firm* — Bay State IP, LLC

(57) ABSTRACT

A folding stringed instrument has a narrow body, a neck with a fret board and strings. Tuning pegs and a bridge are on a front face of the body, with an optional microphone pick-up and a stand at the end of the body. The neck and body are connected about a pivot set back from the face.
The pivot comprises a pin between the opposite sides of the flange and a secondary roller. The neck is formed of an aluminum channel, with the fret board secured to one side and a closure plate closing the channel. Trunnions extend from the channel at the body end of the neck for connection to the pin. At the head end, the web of the channel is cut away and the flanges bent inwards in a lazy Z manner to support a further pivot pin for a primary roller around which the strings pass.

12 Claims, 7 Drawing Sheets

(56) References Cited

U.S. PATENT DOCUMENTS

| | | | | |
|---|---|---|---|---|
| 7,365,254 | B2 * | 4/2008 | Johansson | G10D 1/08 84/293 |
| 7,652,205 | B2 * | 1/2010 | Leach | G10D 1/08 84/267 |
| 7,816,592 | B2 * | 10/2010 | Babicz | G10D 3/06 84/267 |
| 7,872,185 | B1 * | 1/2011 | Chadwick | G10D 1/08 84/275 |
| 7,902,442 | B2 * | 3/2011 | Leach | G10D 1/08 84/293 |
| 8,183,446 | B1 * | 5/2012 | Ward | G10D 1/08 84/267 |
| 8,203,058 | B2 * | 6/2012 | Leach | G10D 1/08 84/267 |
| 8,273,974 | B1 * | 9/2012 | Gonzalez | G10D 1/085 84/267 |
| 9,224,370 | B1 * | 12/2015 | Sanzo | G10D 3/06 |

* cited by examiner

FOLDING STRINGED INSTRUMENT

CROSS REFERENCE TO RELATED APPLICATION

This application is for entry into the U.S. National Phase under §371 for International Application No. PCT/GB2014/052606 having an international filing date of Aug. 28, 2014, and from which priority is claimed under all applicable sections of Title 35 of the United States Code including, but not limited to, Sections 120, 363, and 365(c), and which in turn claims priority under 35 USC 119 to British Patent Application No. 1315523.9 filed on Aug. 30, 2013.

The present invention relates to a folding stringed instrument, in particular though not exclusively a folding guitar.

Many designs of folding guitar have been proposed. Nevertheless the folded instrument is often still bulky. My intention was to develop an instrument that could fold to fit in normal luggage.

Many folding guitars fold in such a way that the fret board lies on the front of the body of the guitar. I find it difficult to imagine such an arrangement being satisfactory, since fret board must be folded out to its use position against the tension of the strings, during the final folding out movement.

British patent application No GB2485170 proposes in terms of abstract:

A guitar is provided with a hinge at the junction of the neck part and the body part so that the neck may fold backwards to within the body of the guitar for compact storage. The strings are maintained in their natural tensioned state around the outside diameter of the hinge. A mechanism is provided to ensure that the string tension remains as tuned throughout the process of folding and storing whereby the connection point of the strings at the headstock moves in compensation for the diameter of the hinge around which the strings pass. The movable mechanism at the headstock might be rotatable and may be connected to the hinge by a cable.

The object of the present invention is to provide an improved folding guitar, utilising the backward folding element of GB2485170 and indeed the movement during folding of the connection point of the strings, but avoiding the complexity of maintaining the strings in permanent tension.

According to the invention there is provided a folding stringed instrument comprising:

- a body having string tuning pegs and, on a front face, a bridge;
- a neck and fret board, pivotally connected to the body for folding under the body, towards a back face thereat
- a pivot between the neck and the body at the body end of the neck and the neck end of the body;
- stop for stopping pivotal movement of neck from moving under string tension towards the front face of the body beyond a playing position with the neck extending from the body;
- a roller at the stock end of the neck for tangentially holding the strings in a tensioned playing position and
- a tension member passing in a tangential direction from the roller and oppositely from the strings to an anchorage on the body, the arrangement being such that:

- in the playing position, the string tension is reacted by the roller and the strings hold the neck in its position stopped by the stop and
- in the folded position, the run of the tension member from the stock roller to the anchorage remains constant or shortens, keeping constant or relieving tension in the tension member.

If the anchorage is coincident with the pivot, the length of the run remains constant. If the anchorage is positioned on the body side of the pivot, the run shortens and the tension is relieved on folding of the neck towards the body.

The run of the tension member can be clear of the pivot. However in the preferred embodiment, the pivot has a second roller against which the tension member runs in the playing position to determine that the tension member-to-pivot axis dimension is less than the string-to-pivot axis dimension.

Whilst it is envisaged that strings could pass over the roller and be connected to the tension member remote from roller, preferably the connection is on the roller. In the preferred embodiment, the strings and the tension member are connected to the roller.

Whilst it is envisaged that the stop could be a finger passing from either the neck or the body to abut on the other on the string side of the pivot; in one embodiment the stop is comprised of two links on the tension member side of the pivot and connected to the neck and the body in the manner of a parallelogram linkage, with an abutment, preferably adjustable on the second roller.

In another embodiment, the stop is a tab which extends from the neck, engaging with an abutment fitted to the body at the pivot. An adjustment screw can be provided threaded in the abutment for adjusting the use position of the neck with respect to the body.

In accordance with significant features of the first embodiment:

- the tension member, conveniently a strap, passes in a serpentine member around pegs or through slotted members in the neck to provide it with short lengths such as not to be resonant in a manner to interfere with the instrument;
- the neck is comprised of a channel with a closure plate to form a sound box.

To help understanding of the invention, two embodiments will now be described by way of example and with reference to the accompanying drawings, in which.

Figure 1:
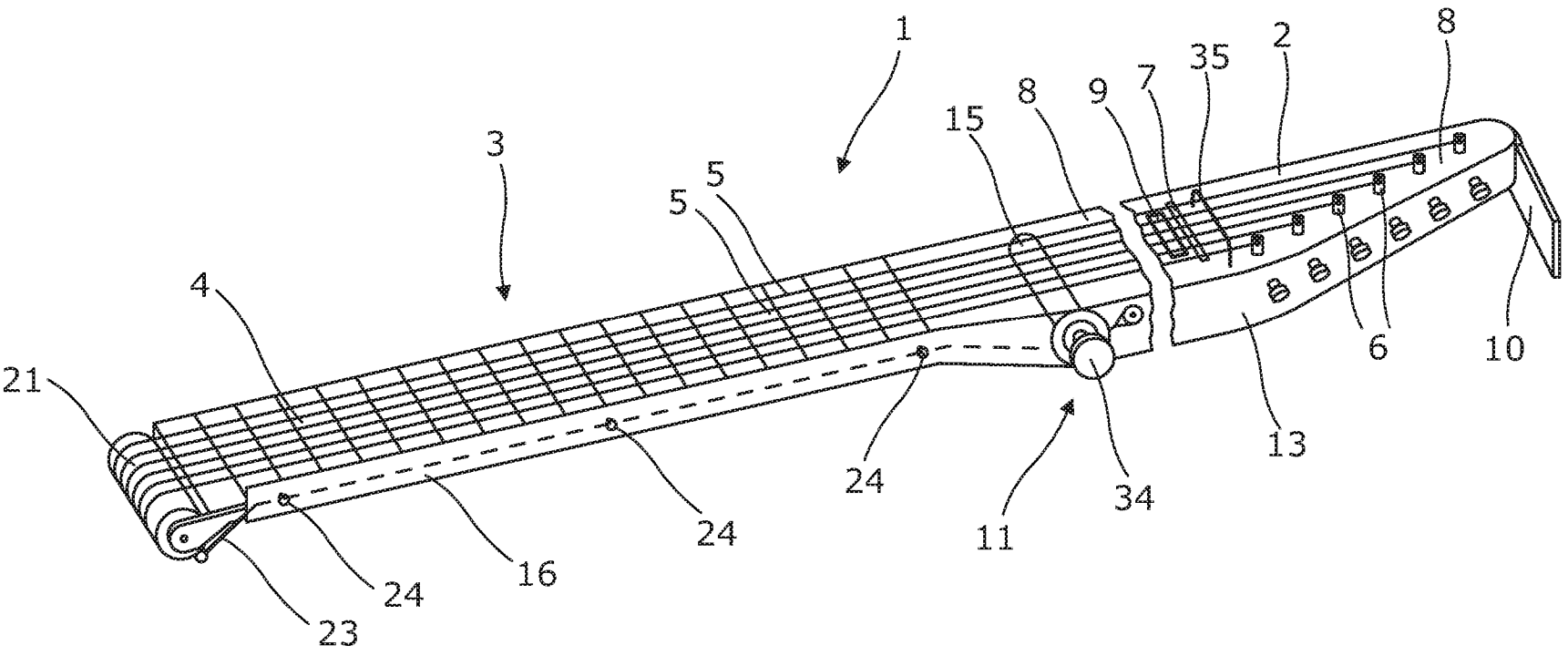
FIG. 1 is a perspective view of a folding guitar in accordance with the invention.
Figure 2:
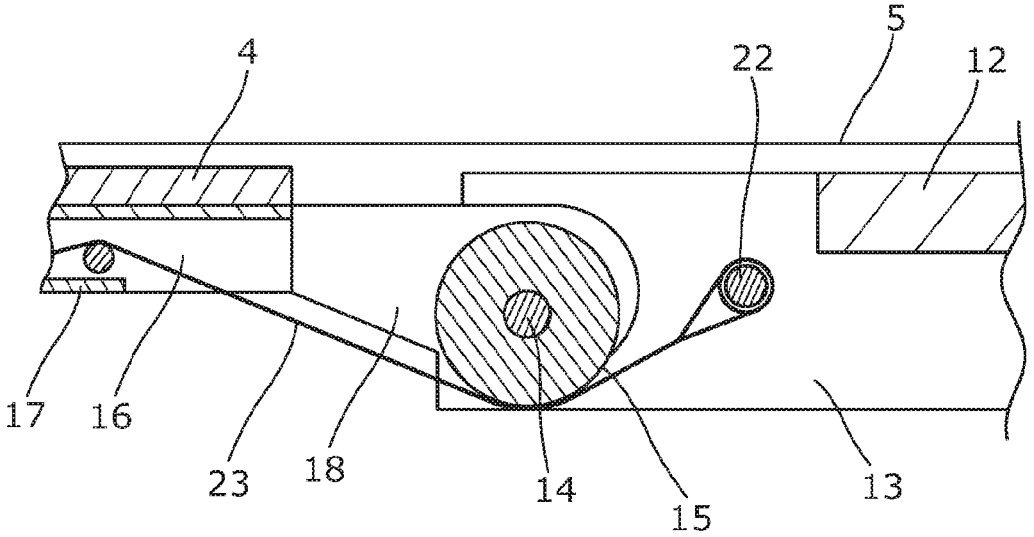
FIG. 2 is a central, cross-sectional side view through the pivot of the folding guitar of FIG. 1 showing a strap run at the pivot.
Figure 3:
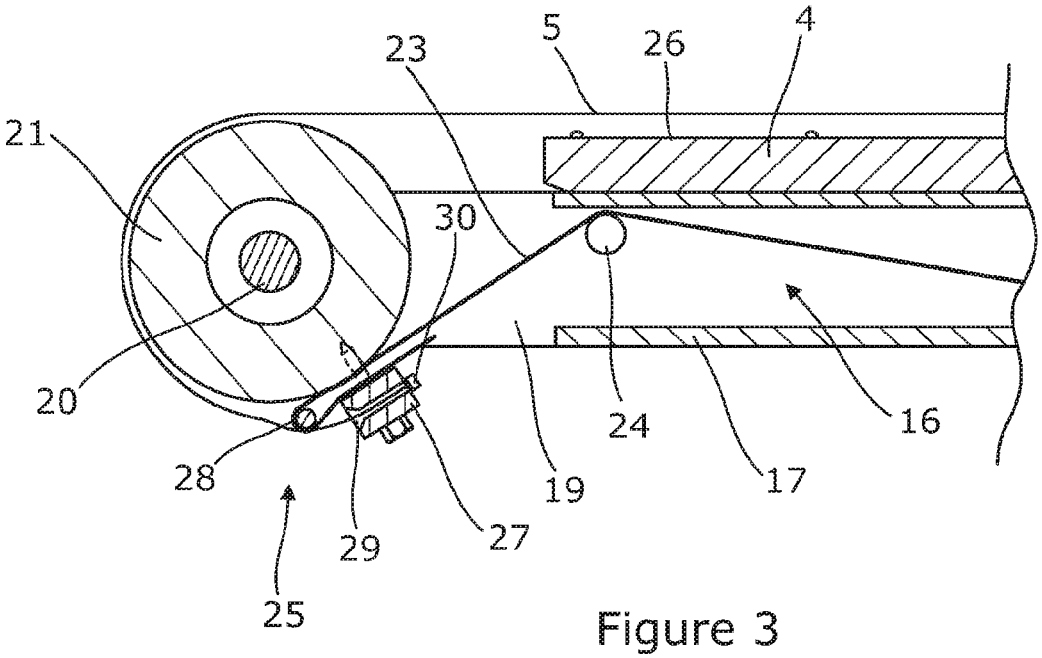
FIG. 3 is a similar central, cross-sectional side view through a head roller at the end of the neck of the guitar of FIG. 1.
Figure 4:
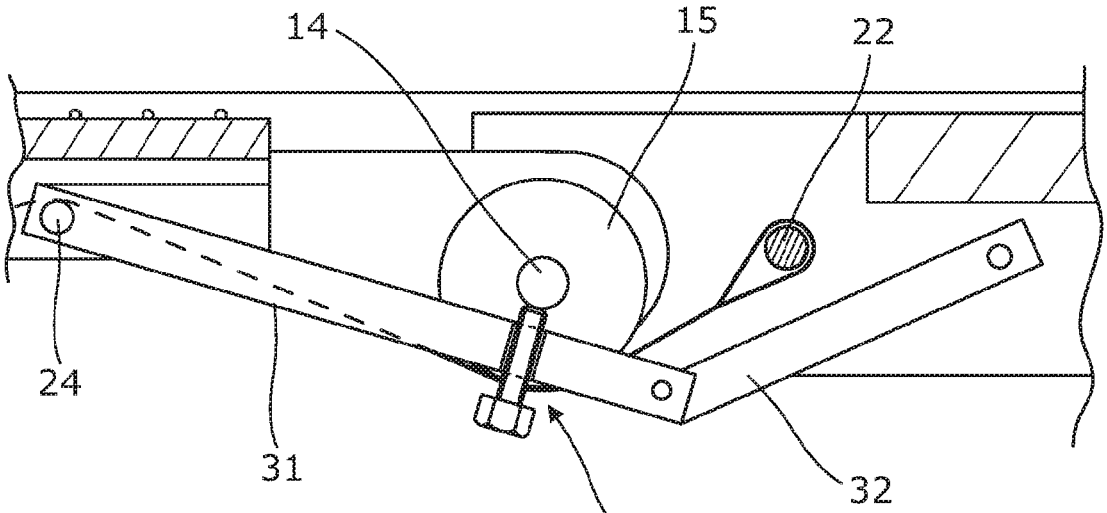
FIG. 4 is an off-central cross-sectional side view through the pivot of the folding guitar of FIG. 1 showing a pivotal movement stop at the pivot.
Figure 5:
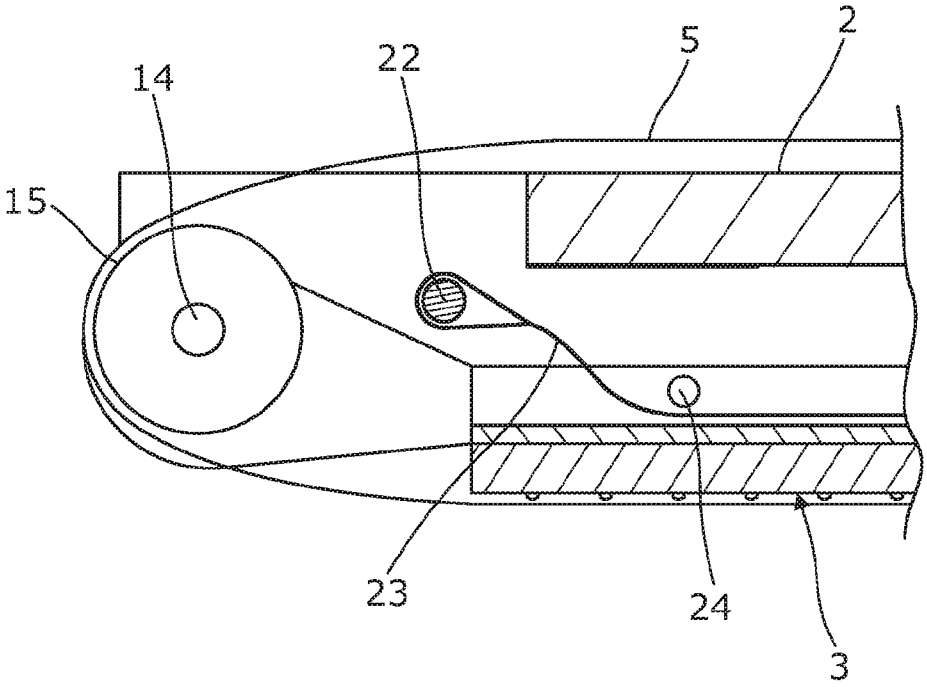
FIG. 5 is a view similar to FIG. 2 showing the pivot end of the neck in the folded position.

Referring to the drawings, the folding guitar 1 there shown has a narrow body 2, a neck 3 with a fret board 4 and strings 5. Tuning pegs 6 and a bridge 7 are provided on a front face 8 of the body, together with an optional microphone pick-up 9 and a stand 10 at the end of the body. The neck and the body are pivotally connected about a pivot 11 set back from the face, whereby the neck can swing under the body. Centrally this is of wood board 12 with a deeper aluminium edging flange 13 for stiffness, enabling the neck to be swung against the board between opposite sides of the flange. The result is that the folded instrument is truly compact and can, for instance, fit readily into luggage.

The pivot 11 comprises a pin 14 between the opposite sides of the flange and a secondary roller 15. The neck is formed of a shallow aluminium channel 16, with the fret board secured to one side and a closure plate 17 closing the channel. Trunnions 18 extend from the channel at the body end of the neck for pivotal connection to the pin 14. At the head end, the web of the channel is cut away and the flanges 19 bent inwards in a lazy Z manner to support a further pivot pin 20 for a primary roller 21 around which the strings pass as now described. A non-shown bearing is provided for the roller 21 on the pin 20.

Close to the pivot 11, on the body side of it, a strap anchoring pin 22 is supported between the opposite sides of the body flange. A strap 23 extends from the pin 22 past the secondary roller 15 and long inside the neck channel passing in a serpentine manner around three strap run pegs 24 supported in the flanges 19. The head end of the strap is secured to the head ends of the strings on the surface of the primary roller. With the neck extended to the playing position, the strings pass from the bridge along the fret board and around the roller to a position 25 on the underside of the roller with respect to the face 26 of the fret board. Slightly to the body side of this position a clamp block 27 is screwed to the roller surface. The clamp bar 27 spaces the strings from each other and the point at which they tangentially leave the roller 21 is the string end point, determining their resonance. The end of the strap passes between the roller surface and the block, around a pin 28 and back under the block. The screws and the block clamp the end of the strap. The block has a passage 29 for each string, with the sting's end piece 30 on the neck channel side of the block. The tension in the strings is reacted on the roller and the roller is restrained from rotating by the strap, which is tensioned to the extent of the sum of the string tension. The strap passes tangentially from the primary roller to the nearest of the strap run pegs 24. This arrangement is such that effective length of the strings—for tuning—is the distance from the bridge to the point at which the strings tangentially contact the roller.

The strap passes the secondary roller in contact with it. The strings are spaced from it and exert a greater torque on the neck. It is restrained from swinging towards the face of the body by a pair of links 31, 32 pivoted together and to the flanges of the neck and body. A stop 33 on link 31 reacts against the pin 14 to determine the extended, playing position of the neck with respect to the body.

One point of detail is an eye 34 on the end pivot pin 14 to hang the guitar from for playing.

On folding of the neck towards the body, strings come into contact with the secondary roller and at first they remain tensioned as the neck is swung. On continued swinging, the run of the strap under the secondary roller 15 comes clear of the roller as the straight run from the anchoring pin 22 to the first of strap run pegs 24, which also supports the link 31 on the neck. Once the strap is clear of the secondary roller, its tension is released on further swinging of the neck under the body. Nevertheless, the run of the strings around the secondary roller rotates the primary roller, which draws the strap 23 into the neck 3, causing the strap to extend direct from the pin 22 to the first peg 24. To retain the strings from sliding sideways off the bridge and the secondary roller when the guitar is folded, a guide hoop 35 is provided between the bridges and the tuning pegs.

I have discovered that with the structure sufficiently stiff to maintain the string tension during playing it is also sufficiently stable for the string tension to be reinstated when the neck is swung out again.

In the second embodiment of FIGS. 6 to 11, the links 31 and 32 are replaced. The neck is restrained from swinging towards the face of the body by a tab 45 extending from the neck that engages with an abutment 46 fitted to the body at the pivot. The abutment is shaped to fit around both the pins 114 and 122. An adjustment screw 47 threaded through an aperture 50 in the abutment has a nut and bolt arrangement 48 on the top to reduce wear on the stop tab, meaning that the stop point and consequently the resting angle of the neck to the body can be adjusted.

Figure 6:
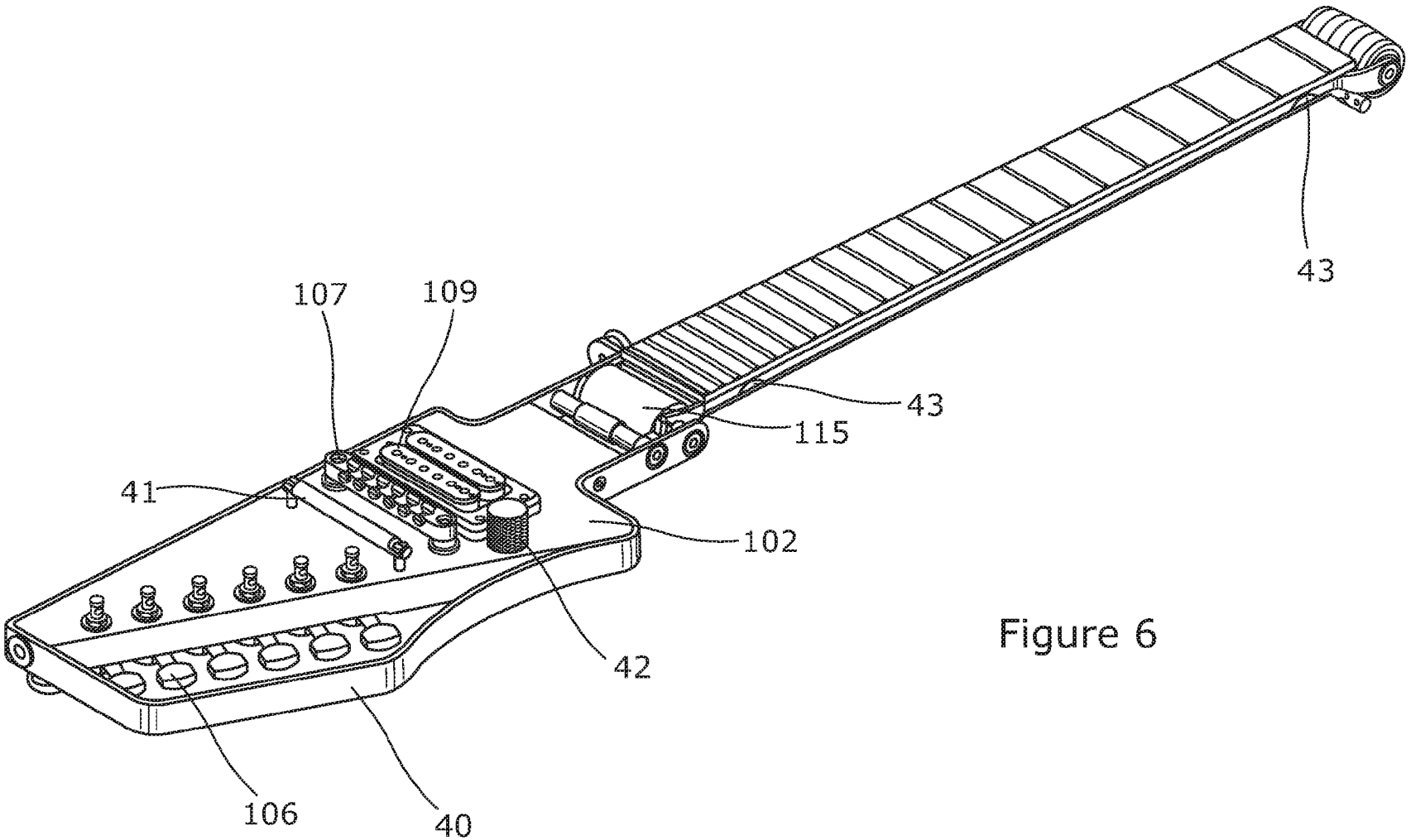
FIG. 6 is a perspective view of a second embodiment of the folding guitar in accordance with the invention.
Figure 7:
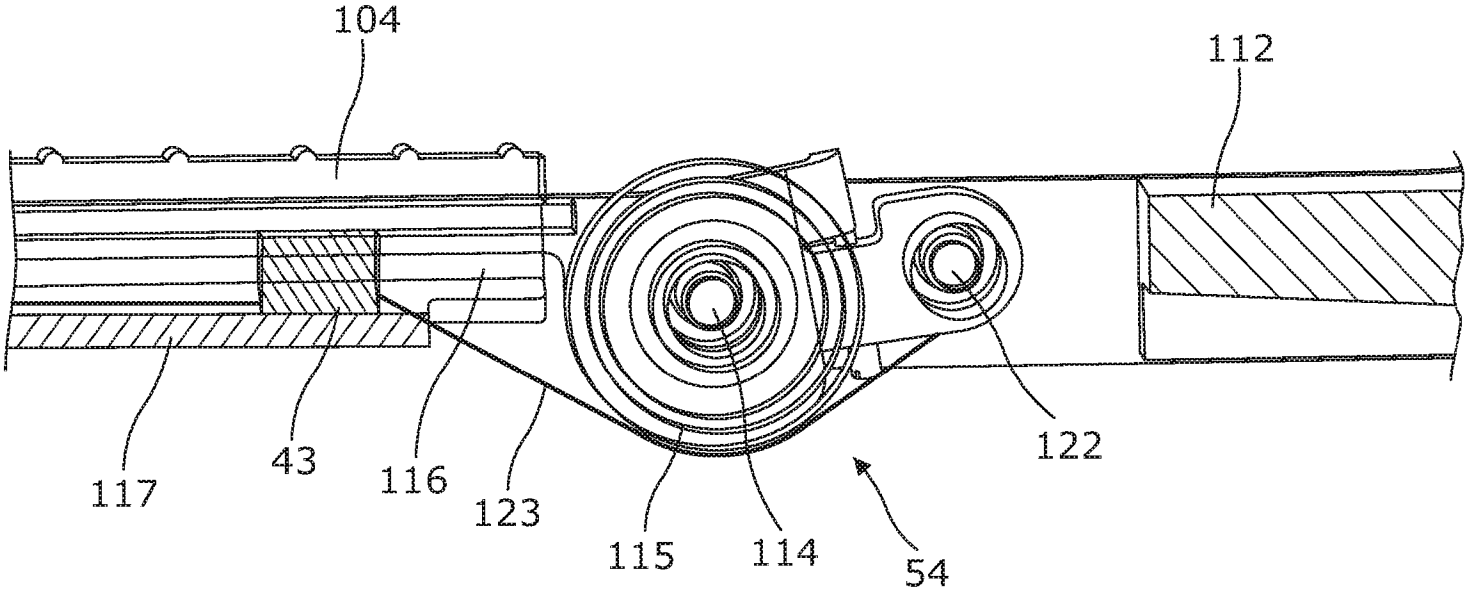
FIG. 7 is a central, cross-sectional side view through the pivot of the folding guitar of FIG. 6 showing a strap run at the pivot.
Figure 8:
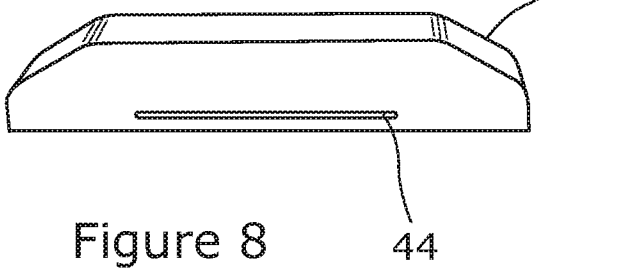
FIG. 8 is a perspective view of a slotted member.

In FIG. 6 the stand is a stand bar 40 which is joined to the main body 102 outline to create a lap support. This extends around the peg side of the guitar. To retain the strings from sliding sideways off the bridge 107 and the secondary roller 115 when the guitar is folded, a string guide bar 41 is fitted between the bridge and the tuning pegs 106. There is also a volume button 42 next to the microphone pick up 109.

Close to the pivot 54, on the body side of it, a strap anchoring pin 122 is supported between the opposite sides of the body flange. A strap 123 extends from the pin 122 past the secondary roller 115 and long inside the neck channel passing through slits 44 in two slotted members 43, supported in the flanges 19. The neck is formed of a shallow aluminium channel 116, with the fret board 104 secured to one side and a closure plate 117 closing the channel. The body is formed of a thick wood board 112.

Figure 10:
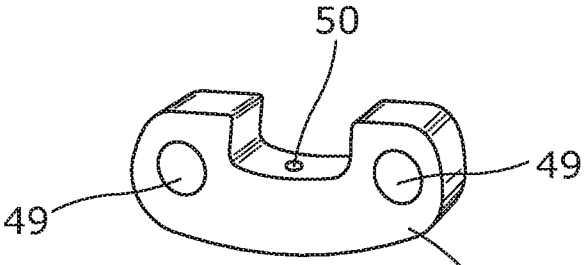
FIG. 10 is view of the abutment to be engaged with the movement stop.
Figure 9:
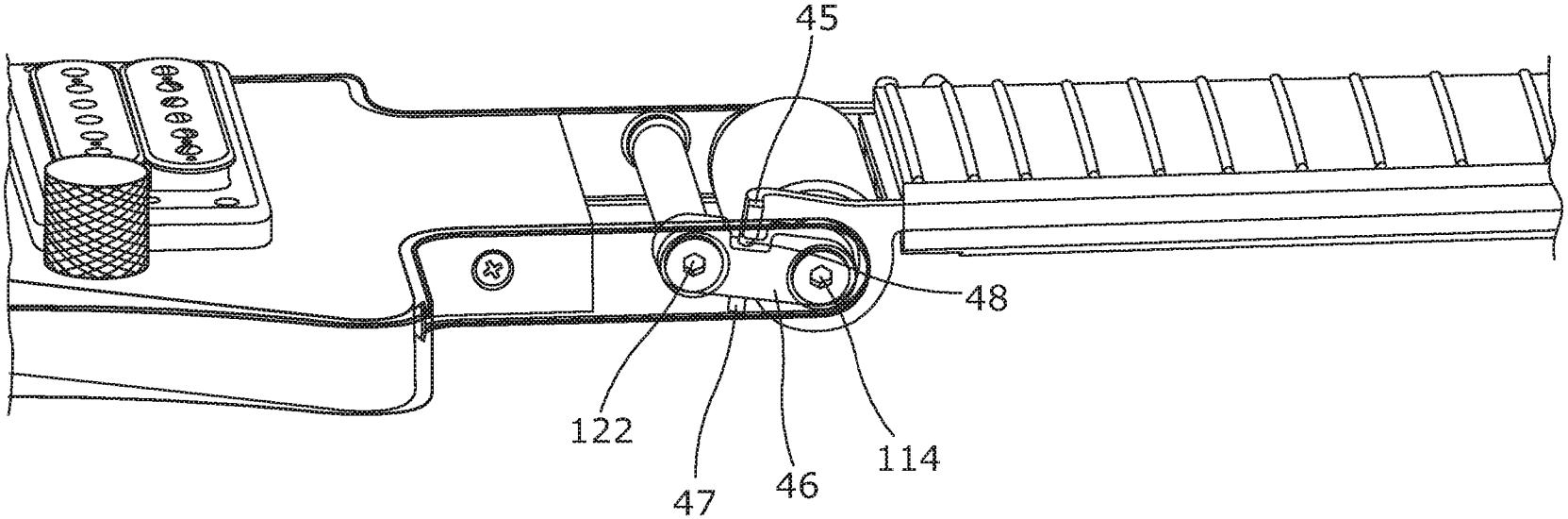
FIG. 9 is an off-central side view of the pivot of the folding guitar of FIG. 6 showing a movement stop at the pivot.
Figure 11:
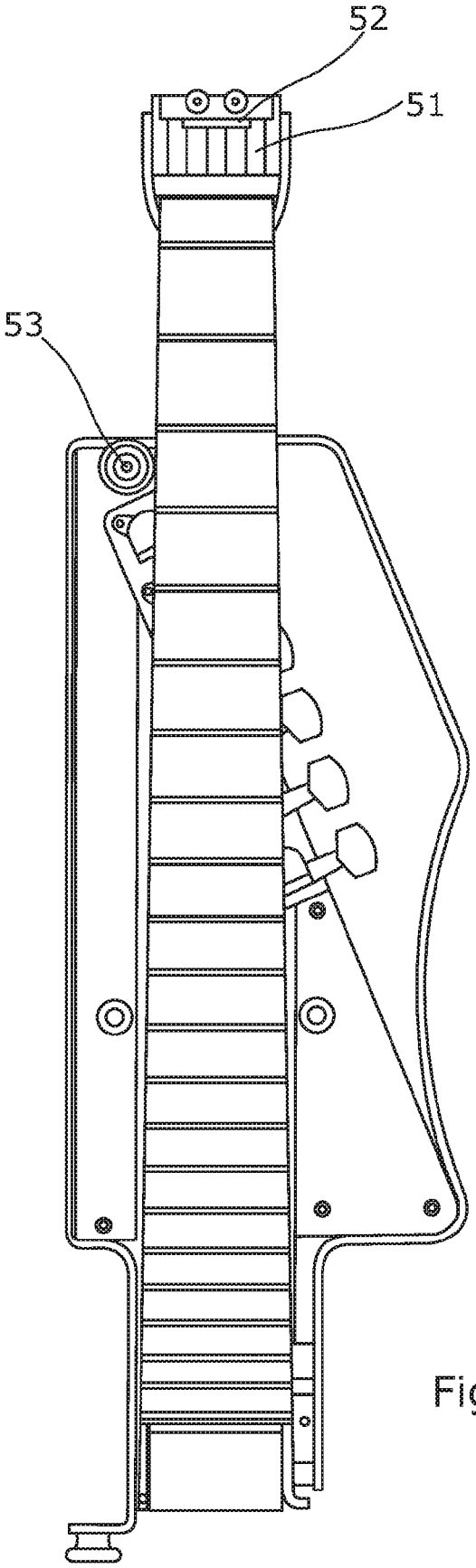
FIG. 11 is a view from the underside of the guitar of FIG. 6 when folded.

FIG. 10 shows the abutment having apertures 49 through which the pins 114 and 122 can fit and an aperture 50 through which the adjustment screw 47 can be threaded. FIG. 11 shows a different perspective of the guitar. 51 is a contoured primary roller that has slots to receive the strings. This could be stepped to line up with the bottom of the string slots to maintain the same string height. 52 is a thumb support tab for providing a rest for the thumb when playing the first fret. 53 is a strap button or eye to hang the guitar from for playing.

Insofar as my above described guitar incorporates a number of original features, they may be applicable to conventional guitars. In particular, I can envisage the tension strap and the primary roller being incorporated as a separate invention into a conventional guitar.

The invention claimed is:

1. A folding stringed instrument comprising:

a body having string tuning pegs and, on a front face, a bridge;

a neck and fret board, pivotally connected to the body for folding under the body, towards a back face thereof;

a pivot between the neck and the body at the body end of the neck and the neck end of the body;

stop for stopping pivotal movement of neck from moving under string tension towards the front face of the body beyond a playing position with the neck extending from the body;

a roller at the stock end of the neck for tangentially holding the strings in tensioned position in a playing position and a tension member passing in a tangential direction from the roller and oppositely from the strings to an anchorage on the body, the arrangement being such that:

in the playing position, the string tension is reacted by the roller and the strings hold the neck in its position stopped by the stop and in the folded position, the run of the tension member from the stock roller to the anchorage remains constant or shortens, keeping constant or relieving tension in the tension member.

2. A folding instrument according to claim 1 where the anchorage is coincident with the pivot, whereby the length of the run remains constant.

3. A folding instrument according to claim 1 where the anchorage is positioned on the body side of the pivot, whereby the run shortens and the tension is relieved on folding of the neck towards the body.

4. A folding instrument according to claim 1 wherein the pivot comprises a pivot pin carrying a second roller against which the tension member runs in the playing position to determine that the tension member-to-pivot axis dimension is less than the string-to-pivot axis dimension.

5. A folding instrument according to claim 1 wherein the strings and the tension member are connected on the roller.

6. A folding instrument according to claim 1 wherein the strings and the tension member are connected to the roller.

7. A folding instrument according to claim 1 where the stop is comprised of two links on the tension member side of the pivot and connected to the neck and the body in the manner of a parallelogram linkage, with an abutment against the roller.

8. A folding instrument according to claim 1 where the stop comprises a tab extending from the neck engaging with an abutment, and an adjustable stop.

9. A folding instrument according to claim 7 wherein the abutment is adjustable.

10. A folding instrument according to claim 1 wherein the tension member passes in a serpentine member around pegs in the neck.

11. A folding instrument according to claim 1 where the tension member passes through slotted members in the neck.

12. A folding instrument according to claim 1 where the tension member is a strap.

* * * * *